US009150381B2

(12) United States Patent
Li et al.

(10) Patent No.: US 9,150,381 B2
(45) Date of Patent: Oct. 6, 2015

(54) EXPANSION DEVICE FOR HOLDING AND SECURING ROLLED MATERIAL

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Bing Li, Shenzhen (CN); Bo Yang, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 189 days.

(21) Appl. No.: 13/944,248

(22) Filed: Jul. 17, 2013

(65) Prior Publication Data

US 2014/0042262 A1 Feb. 13, 2014

(30) Foreign Application Priority Data

Aug. 13, 2012 (CN) ..... 2012 1 0285893

(51) Int. Cl.
*B65H 75/24* (2006.01)

(52) U.S. Cl.
CPC ..... *B65H 75/246* (2013.01); *B65H 75/242* (2013.01)

(58) Field of Classification Search
CPC ..... B65H 75/24; B65H 75/242
USPC ..... 242/572, 573, 573.1–573.3
See application file for complete search history.

(56) References Cited

U.S. PATENT DOCUMENTS

| | | | | |
|---|---|---|---|---|
| 459,200 | A * | 9/1891 | Fransworth | 242/573.2 |
| 2,280,370 | A * | 4/1942 | Bennett | 242/573.1 |
| 8,910,899 | B2 * | 12/2014 | Miyamoto et al. | 242/571 |
| 2009/0308968 | A1 * | 12/2009 | Piotrowski et al. | 242/573.2 |

FOREIGN PATENT DOCUMENTS

| | | |
|---|---|---|
| CN | 201755930 U | 3/2011 |

* cited by examiner

*Primary Examiner* — Sang Kim
(74) *Attorney, Agent, or Firm* — Novak Druce Connolly Bove + Quigg LLP

(57) ABSTRACT

An expansion device configured for securely holding a rolled material when the rolled material is handled on roller is disclosed. The expansion device includes a roller spindle, two expansion members, a fixing sleeve, a clamping nut, and a locking member. The locking member moves toward the expansion members, so that the two expansion members expand toward the fixing sleeve, and protrusions which are formed on the expansion members are pressed outward through fixing holes of the fixing sleeve, and then resist against an inner surface of rolled material inside a rolling hole formed therethrough the rolled material. Thus, the rolled material is held securely by the expansion device.

7 Claims, 5 Drawing Sheets

EXPANSION DEVICE FOR HOLDING AND SECURING ROLLED MATERIAL

BACKGROUND

1. Technical Field

The present disclosure relates to expansion devices, and particularly to an expansion device for holding and securing rolled materials.

2. Description of the Related Art

When a rolled material is involved in a manufacturing process, an expansion device is required to hold or secure the rolled material onto a roller spindle or mandrel. A typical expansion device includes a roller and two expansion members movably mounted on opposite ends of the roller. Each expansion member includes an inclined surface. Inclined directions of the two inclined surfaces of the two expansion members are opposite to each other. The roller is inserted into an axial hole of the rolled material. When the two expansion members move away from each other, the inclined surfaces resist against opposite ends of the rolled material, respectively, such that the rolled material is being securely held, and can rotate along with the roller. However, the inclined surfaces of the expansion members contact the rolled material in a linear fashion, so that resisting forces exerted therebetween are relatively small. Thus, the rolled material easily slips relative to the roller.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
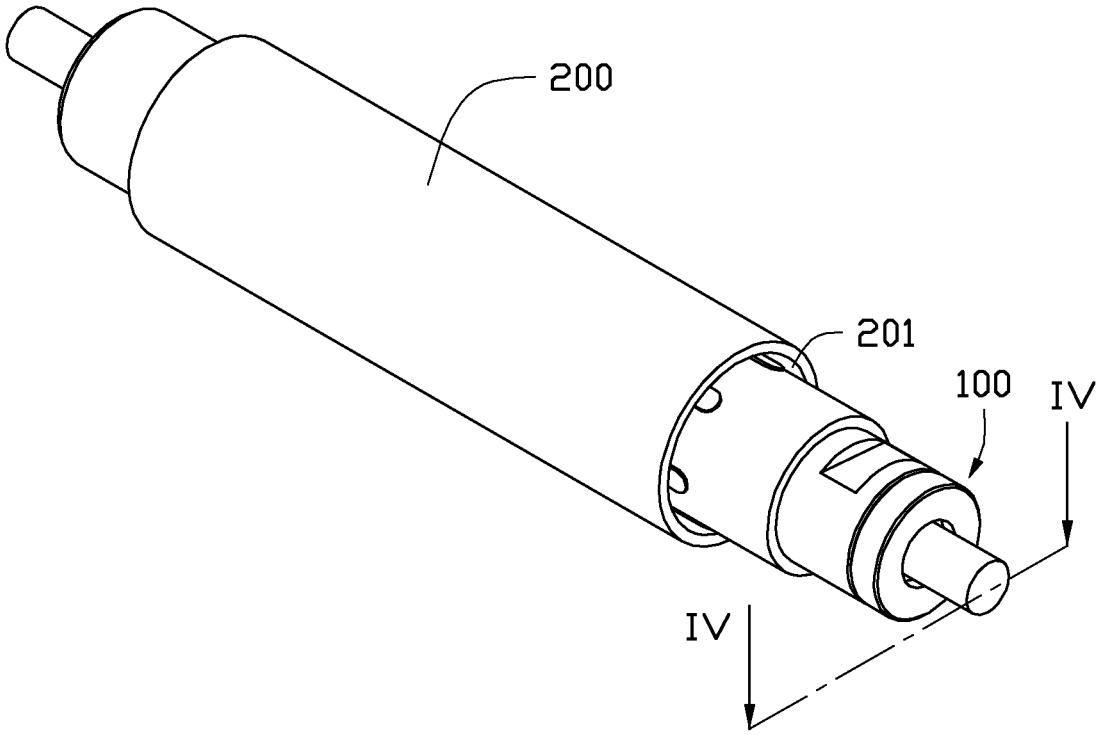
FIG. 1 shows an expansion device of one embodiment being used in manufacturing.
Figure 2:
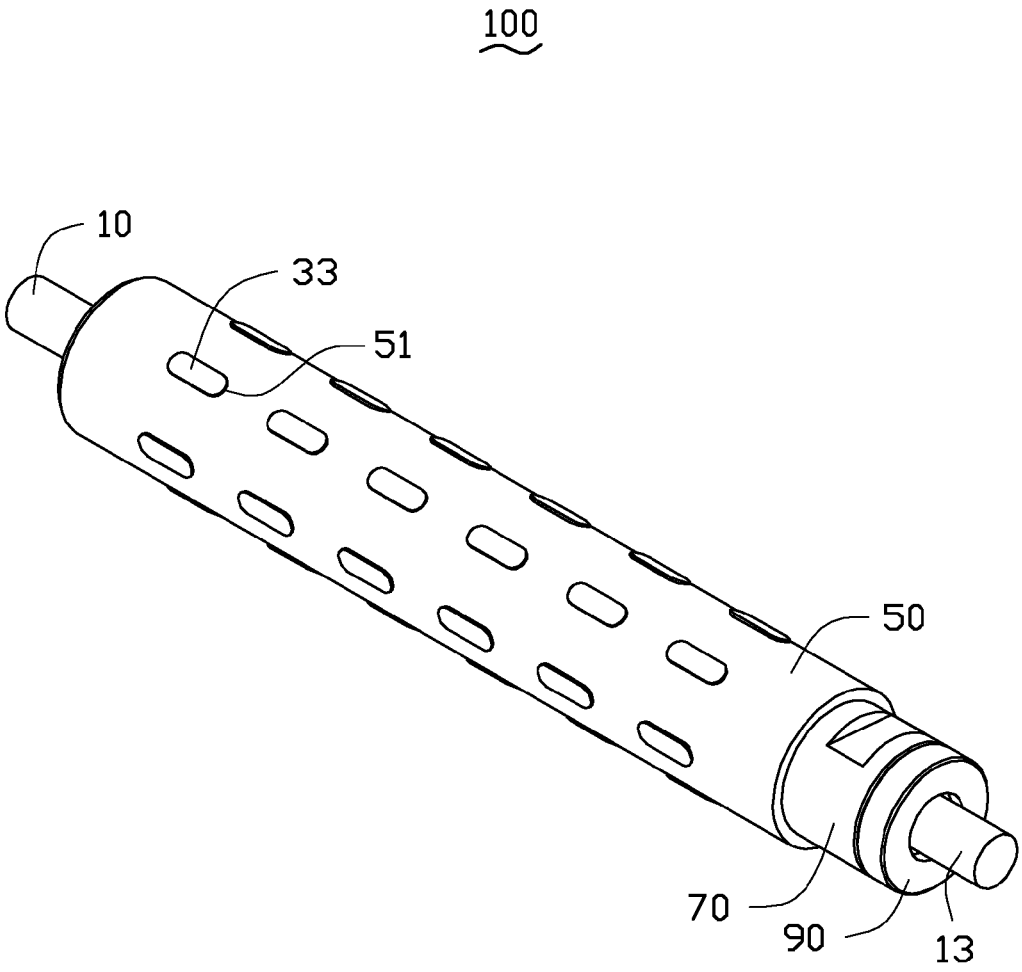
FIG. 2 is an assembled, isometric view of the expansion device of FIG. 1.

FIGS. 1 and 2 show an embodiment of an expansion device 100 for holding or securing a rolled material 200 to a roller spindle. The rolled material 200 axially defines a rolling hole 201 therethrough. The expansion device 100 is inserted in the rolling hole 201 of the rolled material 200, and resists against an inner surface of the rolled material 200 inside the rolling hole 201, such that the rolled material 200 can rotate along with the expansion device 100. The expansion device 100 includes a roller spindle 10, two expansion members 30, a fixing sleeve 50, a pushing member 70, and a locking member 90.

Figure 3:
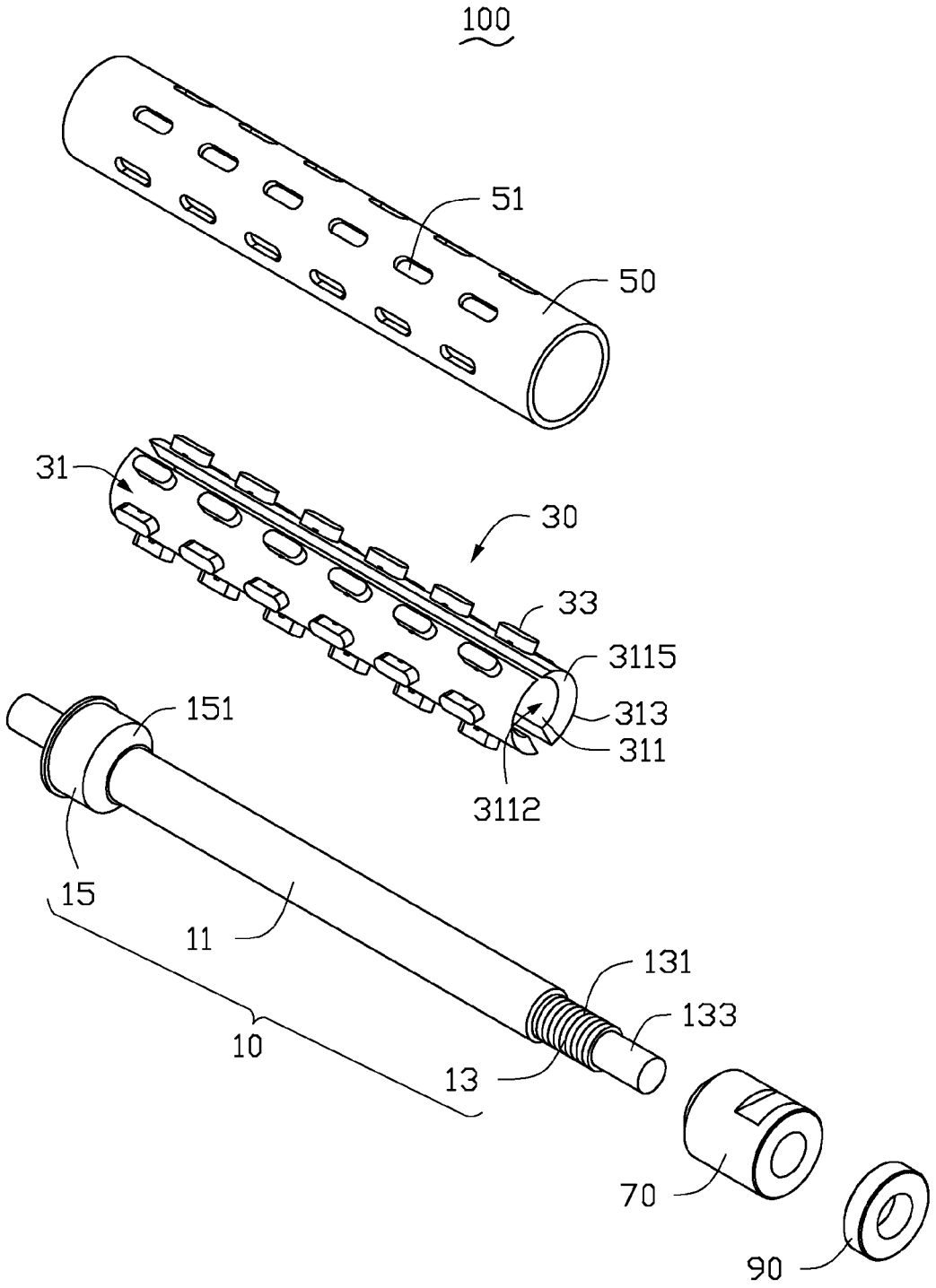
FIG. 3 is a partial, disassembled, and isometric view of the expansion device of FIG. 1.

Referring to FIG. 3, the roller spindle 10 includes a sleeve portion 11, a threaded portion 13 axially extending from one end of the sleeve portion 11, and a resisting portion 15 radially extending from the other end of the sleeve portion 11 opposite to the threaded portion 13. The sleeve portion 11 is substantially cylindrical. The threaded portion 13 is substantially cylindrical and coaxial with the sleeve portion 11. The threaded portion 13 includes a first portion 131 extending from the sleeve portion 11 and a second portion 133 axially extending from a free end of the first portion 131. A diameter of the second portion 133 is smaller than that of the first portion 131. The resisting portion 15 includes a first inclined surface 151 on one end thereof adjacent to the sleeve portion 11. In profile, the first inclined surface 151 is sloped or tilted downward along an axis of the roller spindle 10 at a direction toward the threaded portion 13.

Figure 4:
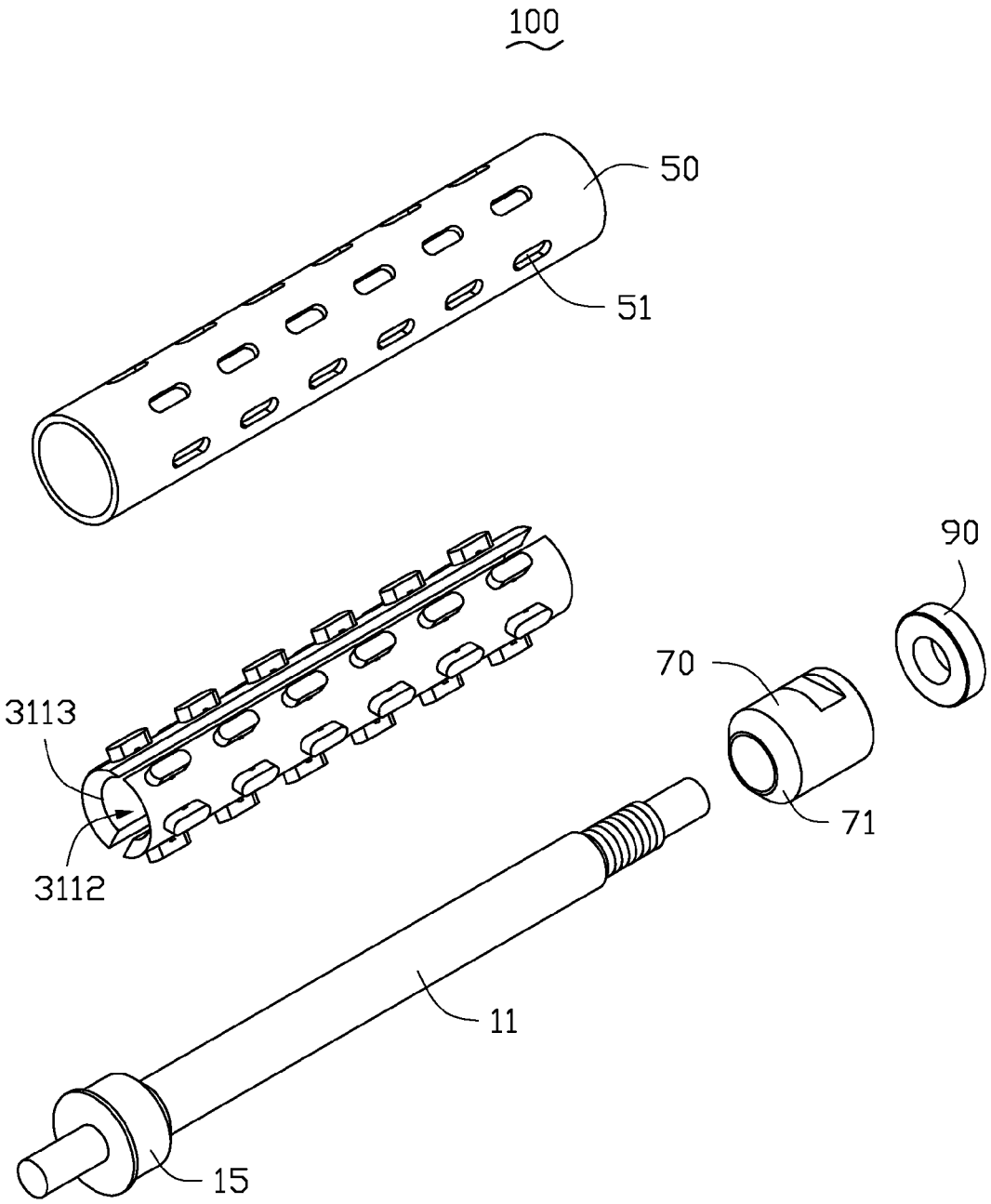
FIG. 4 is similar to FIG. 3, but viewed from another aspect.
Figure 5:
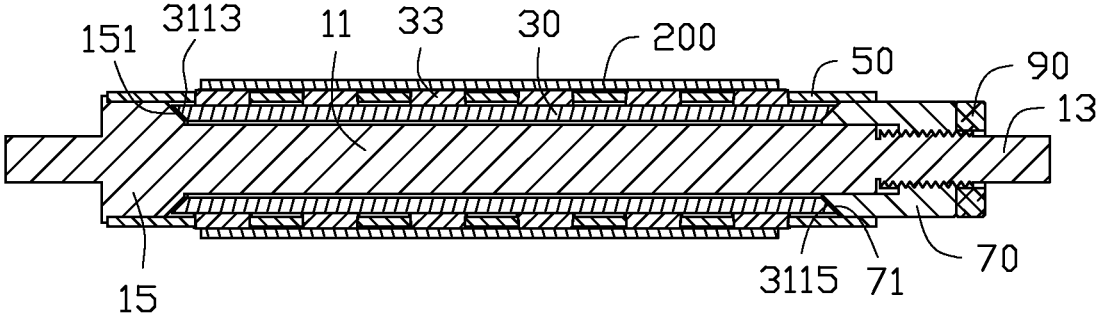
FIG. 5 is a cross-sectional view of the expansion device, taken along line IV-IV of FIG. 1.

Referring also to FIG. 4, the two expansion members 30 are mounted on the sleeve portion 11 of the roller spindle 10. Each expansion member 30 includes a main body 31 and a plurality of protrusions 33 formed on the main body 31 and spaced from each other. In an illustrated embodiment, the main body 31 is substantially hollow and semi-cylindrical, and includes an inner surface 311, an outer surface 313, a second inclined surface 3113 (shown in FIG. 4), and a third inclined surface 3115. The inner surface 311 and the outer surface 313 are curved surfaces. The inner surface 311 defines a semi-circular groove 3112. The second inclined surface 3113 and the third inclined surface 3115 are formed on opposite ends of the main body 31. The second inclined surface 3113 connects one end of the inner surface 311 to one end of the outer surface 313. The third inclined surface 3115 connects the other end of the inner surface 311 to the other end of the outer surface 313. In profile, the second inclined surface 3113 is downward sloped along the axis of the roller spindle 10 at a direction toward the threaded portion 13. The third inclined surface 3115 is also downward sloped in profile towards the axis of the roller spindle 10, but along a direction away from the threaded portion 13. The sleeve portion 11 is received in two semi-circular grooves 3112 of the two expansion members 30, and the second inclined surface 3113 resists against the first inclined surface 151. In the illustrated embodiment, the inner surface 311, the outer surface 313, the second inclined surface 3113, and the third inclined surface 3115 are coaxial. In another embodiment, the inner surface 311 can be of another shape, as long as the inner surface 311 engages with the sleeve portion 11. The protrusions 33 substantially perpendicularly protrude from the outer surface 313 of the main body 31.

The fixing sleeve 50 is a substantially hollow cylinder, and securely sleeves on the outer surfaces 313 of the two expansion members 30. A plurality of fixing holes 51, which are all through holes, is defined in a periphery of the fixing sleeve 50 corresponding to the plurality of protrusions 33. Each protrusion 33 is partly received in one fixing hole 51. An inner surface of the fixing sleeve 50 is spaced from the outer surface 313 of the main body 31, and a size of each protrusion 33 is smaller than that of the fixing hole 51, such that the two expansion members 30 are movable relative to the fixing sleeve 50.

The pushing member 70 is movably sleeved on the threaded portion 13, and resists against the main bodies 31 of the expansion member 30. The pushing member 70 is a substantially hollow cylinder, and includes a fourth inclined surface 71 at one end thereof adjacent to the expansion member 30. The fourth inclined surface 71 engages with the third inclined surface 3115. In profile, the fourth inclined surface 71 is sloped downwardly along the axis of the roller spindle 10 at a direction toward the expansion members 30. The locking member 90 threadedly engages with the first portion 131 of the threaded portion 13, and resists against the pushing member 70. In the illustrated embodiment, the pushing member 70 can be a clamping nut, and the locking member 90 can be a locknut.

In assembly, the two expansion members 30 are mounted on the sleeve portion 11, and the first inclined surface 151 resists against the second inclined surface 3113. Next, the fixing sleeve 50 is sleeved on the outer surfaces 313 of the two expansion members 30. The pushing member 70 is movably sleeved on the threaded portion 13, and the fourth inclined surface 71 resists against the third inclined surface 3115. Last, the locking member 90 is threaded on the first portion 131 of the threaded portion 13, and resists against the pushing member 70.

In use, the rolled material 200 is sleeved on the fixing sleeve 50. The locking member 90 moves toward the expansion members 30, and then the fourth inclined surface 71 resists against the third inclined surface 3115 so as to move the two expansion members 30, move the first inclined surface 151 relative to the second inclined surface 3113, and move the third inclined surface 3115 relative to the fourth inclined surface 71, so that the two expansion members 30 expand toward the fixing sleeve 50. The protrusions 33 pass through the fixing holes 51 and then resist against an inner surface of the rolled material 200 inside the rolling hole 201. Thus, the rolled material 200 is secured on the expansion device 100, and can rotate with the roller spindle 10.

When holding or securing the rolled material 200 on the roller spindle 10, the plurality of protrusions 33 resist against the inner surface of the rolled material 200 inside the rolling hole 201, so that an area of contact formed between the rolled material 200 and the expansion device 100 is relatively large. Thus, a holding or securing force being exerted is greater between the expansion members 30 of the expansion device 100 and the rolled material 200, and the rolled material 200 is prevented from slipping or slippage relative to the expansion device 100.

In another embodiment, the locking member 90 can be omitted, and the pushing member 70 can be directly threaded on the threaded portion 13. A quantity of the expansion members 30 is not limited to two, it can be one or more than two.

It is to be understood, however, that even through numerous characteristics and advantages of the disclosure have been set forth in the foregoing description, together with details of the structure and function of the embodiments, the disclosure is illustrative only, and changes may be made in detail, especially in the matters of shape, size, and arrangement of parts within the principles of the embodiments to the full extent indicated by the broad general meaning of the terms in which the appended claims are expressed.

What is claimed is:

1. An expansion device for holding and securing a rolled material, comprising:

a roller spindle comprising a first inclined surface;

at least one expansion member, each of the at least one expansion member comprising:

a main body comprising a second inclined surface and a third inclined surface formed on opposite ends thereof, the main body mounted on the roller spindle, and the first inclined surface resisting against the second inclined surface;

and a plurality of protrusions formed on the main body and spaced from each other;

a fixing sleeve defining a plurality of fixing holes corresponding to the plurality of protrusions, the fixing sleeve sleeved on the at least one expansion member, and the plurality of protrusions slidably received in the plurality of fixing holes, respectively; and a pushing member movably mounted on one end of the roller spindle away from the first inclined surface, the pushing member comprising a fourth inclined surface, the fourth inclined surface resisting against the third inclined surface of the main body, wherein when the pushing member moves toward the at least one expansion member, the fourth inclined surface moves relative to the third inclined surface, the second inclined surface moves relative to the first inclined surface, so that the main body of the at least one expansion member expands toward the fixing sleeve to resist and securing the rolled material onto the roller spindle.

2. The expansion device for holding and securing the rolled material of claim 1, wherein the roller spindle comprises a sleeve portion, a threaded portion formed on one end of the sleeve portion, and a resisting portion formed on the other end of the sleeve portion opposite to the threaded portion, the main body is mounted on the sleeve portion, the first inclined surface is formed on the resisting portion, the pushing member is movably mounted on the threaded portion.

3. The expansion device for holding and securing the rolled material of claim 2, wherein the first inclined surface slopes downward along an axis of the roller spindle at a direction toward the threaded portion, the second inclined surface slopes downward along the axis of the roller spindle at a direction toward the threaded portion, the third inclined surface slopes downward along the axis of the roller spindle toward a direction away from the threaded portion, the fourth inclined surface slopes downward along the axis of the roller spindle at a direction toward the at least one expansion member.

4. The expansion device for holding and securing the rolled material of claim 1, further comprising a locking member, wherein the locking member is threaded on the threaded portion, the pushing member is moved when the locking member moves toward the at least one expansion member.

5. The expansion device for holding and securing the rolled material of claim 1, wherein each of the at least one expansion member comprises an inner surface and an outer surface, the second inclined surface connects one end of the inner surface to one end of the outer surface, the third inclined surface connects the other end of the inner surface to the other end of the outer surface.

6. The expansion device for holding and securing the rolled material of claim 5, wherein the at least one expansion member comprises two expansion members, the inner surface of each of the two expansion members defines a semi-circular groove, the roller spindle is received in two of the semi-circular grooves of the two expansion members.

7. The expansion device for holding and securing the rolled material of claim 5, wherein the plurality of protrusions are substantially perpendicularly formed on the outer surface, the fixing sleeve is sleeved on the outer surface of the at least one expansion member.

* * * * *